US006715239B2

(12) United States Patent
Passalacqua et al.

(10) Patent No.: US 6,715,239 B2
(45) Date of Patent: Apr. 6, 2004

(54) APPROPRIATE FITTING-OUT STRUCTURES FOR MOIST ROOMS AND THEIR INSTALLATION PROCEDURE

(75) Inventors: Paolo Passalacqua, Recco (IT); Romeo Ronco, Genoa (IT)

(73) Assignees: Precetti S.p.A., Ceranesi (IT); Impresa Marinoni S.r.l., Genoa (IT)

( * ) Notice: Subject to any disclaimer, the term of this patent is extended or adjusted under 35 U.S.C. 154(b) by 0 days.

(21) Appl. No.: 10/066,866

(22) Filed: Feb. 4, 2002

(65) Prior Publication Data

US 2002/0112414 A1 Aug. 22, 2002

(51) Int. Cl.[7] ..... E04H 5/00

(52) U.S. Cl. ..... 52/79.1; 52/287.1; 52/483.1; 52/481.1; 52/302.1; 52/783.11

(58) Field of Search ..... 52/287.1, 483.1, 52/481.1, 783.11, 783.17, 783.19, 302.1, 79.1

(56) References Cited

U.S. PATENT DOCUMENTS

| | | | | | |
|---|---|---|---|---|---|
| 3,999,344 | A | * | 12/1976 | Jansen | 52/265 |
| 4,414,257 | A | * | 11/1983 | Haraga et al. | 428/182 |
| 4,430,834 | A | * | 2/1984 | Rensch | 52/281 |
| 4,667,579 | A | * | 5/1987 | Daw | 454/187 |
| 4,667,580 | A | * | 5/1987 | Wetzel | 454/187 |
| 4,694,736 | A | * | 9/1987 | Yamagata et al. | 454/187 |
| 4,706,427 | A | * | 11/1987 | Zeilinger | 52/287.1 |
| 4,984,400 | A | * | 1/1991 | Bockmiller | 52/241 |
| 5,029,518 | A | * | 7/1991 | Austin | 454/187 |
| 5,256,105 | A | * | 10/1993 | Austin | 454/187 |
| 5,307,600 | A | * | 5/1994 | Simon et al. | 52/241 |
| 5,644,878 | A | * | 7/1997 | Wehrmann | 52/287.1 |
| 5,692,345 | A | * | 12/1997 | Mogaki et al. | 52/483.1 |
| 5,941,040 | A | * | 8/1999 | McAnallen et al. | 52/586.1 |
| 5,962,104 | A | * | 10/1999 | Gertel et al. | 428/116 |
| 5,992,112 | A | * | 11/1999 | Josey | 52/309.8 |
| 6,129,838 | A | * | 10/2000 | Millner | 210/164 |
| 6,155,016 | A | * | 12/2000 | Wacker et al. | 52/588.1 |
| 6,324,799 | B1 | * | 12/2001 | Salvitti | 52/287.1 |
| 6,401,418 | B1 | * | 6/2002 | Senn et al. | 52/506.01 |
| 6,553,732 | B2 | * | 4/2003 | Shaw | 52/287.1 |

FOREIGN PATENT DOCUMENTS

| | | | | |
|---|---|---|---|---|
| FR | 2745045 A1 | * | 8/1997 | F16B/5/06 |
| JP | 401215350 A | * | 8/1989 | B01L/1/04 |
| JP | 02000008519 A | * | 1/2000 | E04B/2/82 |

* cited by examiner

*Primary Examiner*—Carl D. Friedman
*Assistant Examiner*—Brian E. Glessner
(74) *Attorney, Agent, or Firm*—Bucknam & Archer

(57) ABSTRACT

Appropriate fitting-out structures for moist rooms for which retaining sections (9) are used featuring a sloping flap (11) at the point where it is overlapping the flooring (1). The sections (9) are directly glued with structural bonding agent onto the structure below (7). The flooring (1) is then laid and consists of a floor foundation (4), a decorative finishing coat (5), a transparent resin topping (6) with anti-slip characteristics and an anti-scratch and anti-wear blanket.

The retaining section (9) has a lower horizontal edge (10) which is glued onto the structure below (7) and continues with a 45° sloping flap (11) having the same height as the flooring (1) and after a horizontal length (12) where it meets the corner (13), the section is rounded off and follows a vertical path (14) terminating at the top with a sloping edge (15) while it has a horizontal rim (16) at the rear. The panels (25), on which C-shaped elements (18) are glued, are positioned in the retaining sections (9), which are secured at the rear onto the bulkhead (8) by means of supporting brackets (19).

29 Claims, 16 Drawing Sheets

APPROPRIATE FITTING-OUT STRUCTURES FOR MOIST ROOMS AND THEIR INSTALLATION PROCEDURE

BACKGROUND OF THE INVENTION

This invention covers a set of structures particularly suitable for the fitting-out of moist rooms and their installation procedure.

According to a known technique, the flooring of moist rooms is usually consisting of a cement based floor foundation covered by ceramic tiles glued and sealed onto this foundation.

Because of the interstices between tiles and their detachment, this flooring type has the drawback of water seepage, especially in the naval sector, where they may cause corrosion of the lower deck bearing structures. Besides being heavy weighted, these paving tiles by their detachment may cause other defects such as bulking of the floor foundation.

Another drawback of tile paving is generated by the erection of the whole metal structure (aluminium partition walls) and various machines directly resting on the deck below to which they are anchored by welding, thus excessively transmitting to the decks located below and above, any noise caused by the operations performed on the moist rooms.

According to another known technical solution, these drawbacks are obviated by a continuous resin based flooring without tiles, on which the partition panels, furnitures and machines are subsequently mounted.

This known resin based flooring has the drawback that the flooring has to be completed while the room is empty and before the partition panels and other facilities are installed, so that all subsequent works to complete the rooms are carried out on the already completed flooring which may thus be damaged.

The known continuous flooring has also the drawback of its uncertain adhesion in the contact zones between the floor and metal components. After moisture penetration, this drawback is not easy to eliminate because the zone around the seepage area has to be dismantled to prevent the equipment from being damaged, while causing an early ageing of the supporting metal structures and, especially on board of vessels, corrosion of the deck plates which may be perforated in less than ten years.

SUMMARY OF THE INVENTION

The above drawbacks have been eliminated by the structure subject matter of this invention and by its installation procedure.

This invention has the aim to provide a fitting-out with a flooring which eliminates the aforesaid drawbacks while at the same time making available a light-weight structure, easy to install and having the waterproofing and noise damping characteristics required in moist rooms, especially on board of vessels.

To achieve this aim, the structural components and their accessories are prefabricated, to facilitate their installation and minimize the risk of poor installation work.

Particular care has been given to the design of special shaped sections previously glued with structural bonding agents directly on the structure below, so that the erection of the partition panels will be independent of floor laying, which can be laid at a later time and to prevent the floor from being damaged during the initial outfit stage of the area. On board, for example, coamings and box shaped seatings are fastened onto the deck plates to prevent condense water and liquid from seeping into the structures below and to ensure that the flooring can be laid at a later time after the room has almost been completed.

Special attention is focused on a perfect adhesion of the flooring to the sections, made possible by the peculiar shape of these sections, having at their lower part a sloping flap where the flooring overlaps the section, and also thanks to the used adhesives and to the preliminary treatment of the section surfaces with adhesion boosters and/or surface roughing agents.

Some of the numerous advantages offered by this invention are described below.

Installation of the structures is very easier as compared with the known technique, because a retaining section or coaming is mounted directly on the structure below or deck plate, which can easily be perfectly levelled, if necessary by using shims.

The coaming is then sealed off and it is anchored to the deck plates with structural bonding agents.

Special shaped panels are mounted on the coaming. these panels too are advantageously simplified, they are light-weight and their structure and fastening methodology are improved with respect to known solutions.

The inclination of the lower section flap offers the advantage of increasing the contact zone with the flooring, which consists of resin properly batched with special binders, so that it will be possible to butter the resin on the section flap, and the advantage of preventing cracks forming between the section and floor, owing to considerable overlap; finally the advantage of making it easier for the resin exactly to reach the toe of the section and to allow for a small error tolerance in the workmanship. Indeed, should the floor and section not be perfectly aligned, this error would still be accepted according to health standards, because it would still be possible perfectly to clean the floor which would have a pleasant appearance.

Another advantage lies in the fact that the resin can be easily repaired in case of limited adhesion problems and/or if the flooring is damaged caused, for example, by strong concentrated impact, gashes, sabotage. In such cases, it suffices to use a cutter to remove the damaged zone and apply new resin to that area to ensure its restoration.

The lighter weight of the assembled structure as compared with the known technique is an further advantage of this invention, especially for the flooring, reducing its weight by about 60% with respect to the known technique.

Like the peripheral or partition coamings, the drain channels and box shaped seatings are directly glued onto the deck plates, whereas the furnitures and machines will be mounted at a later stage.

Further to ensure perfect waterproofing of the flooring, the drain channels are practically enbloc stainless steel tanks secured to the box shaped seating whenever feasible.

Another advantage, thanks to the drain channel fitted in adhesion to the flooring, is the fact that it is easier to obtain the required slope, with improved sealing and conveyance of the run-off towards the drains.

The panel facing consists of stainless steel plates whereas the back of the panels is in galvanized plate. A corrugated aluminium reinforcement is inserted between the two steel plates to provide adequate rigidity.

The backside of the panels is secured to the bulkheads by C-shaped elements and supporting brackets.

Besides the peculiar section shape, adhesion boosters for stainless surfaces may be applied to the lower flap of the sections in contact with the flooring, to improve their adhesion to the floor foundation.

The stainless steel surface is previously degreased and roughened to roughen the flap in touch with the flooring so that it will be rougher surfaced than the original satined plate and thus better ensure adhesion.

The installation procedure of the structures according to this invention is as follows, e.g. on board of ships.

First of all the coamings are rigged and are then glued onto the deck plate. The panels are then placed and the box shaped seatings and drain channels are glued onto the deck plates. Before the application of the resin, an adhesion booster is applied as a sticker on the metal support (for example on the deck) and on the previously roughened lower flaps of the stainless steel sections, then the foundation is buttered and covered with a finishing coat to be topped with transparent resin incorporating antislip granulates. The operation terminates with the application of a protective product.

The adhesion booster consists of a Xylane based two-component compound.

The glues are single-component polyurethane based structural bonding agents; it will for instance be possible to use a single-component polyurethane thick paste product which hardens upon exposure to air known under the trade name SICAFLEX 252 which is not only used as a bonding agent but also as a sealant.

The foundation consists of a two-component epoxy-polyurethane based product with a foamed micro cellular aluminate filler, which reduces the weight of the compound to a density of 0.9 $kg/m^2$.

The finishing coat consists of a two-component polyurethane based resin with a decorative function and a density of 1.2 $kg/m^2$.

This finishing coat is topped by a transparent polyurethane based resin in which a special anti-slip system is incorporated, if necessary. During the final total cleaning of the moist rooms, a special transparent acrylic-silicone based, antiscratch and antiwear product is applied to this finish.

It must be stressed that the antislip feature should not be accentuated since it would make cleaning more difficult, nor should it be too flimsy since it might cause slipping, especially in some zones, as for instance in the sauce zone.

To prevent slipping in required zones, 60 mesh grain sized aluminium oxide, is strewn on the transparent polyurethane resin, immediately coating this zone with the same transparent polyurethane resin, so that the resin creates by osmosis a support for the anti-slip granules. The best results can be obtained with this system by rolling the first polyurethane based resin coat, then strewing the granules and applying the same resin coat within about 10 minutes, so as to form one single layer. The resin, which initially conglobes the granules, then tends to run downwards as long as it is still fresh, thus letting emerge the top of the granules.

According to a preferred procedure, a foundation of about 25 mm is adopted which is sanded, a 2 mm thick decorative finish is applied, followed by further sanding and the application of a 200$\mu$ transparent polyurethane based resin coat which is finally topped by a 150$\mu$ protective antiscratch product.

BRIEF DESCRIPTION OF THE DRAWINGS

All the above mentioned and other advantages are highlighted in the following figures attached hereto for illustrative but not limiting purposes in which.

DETAILED DESCRIPTION OF THE INVENTION

Elements that are similar have been indicated with the same numerical symbols in the various figures.

Figure 1:
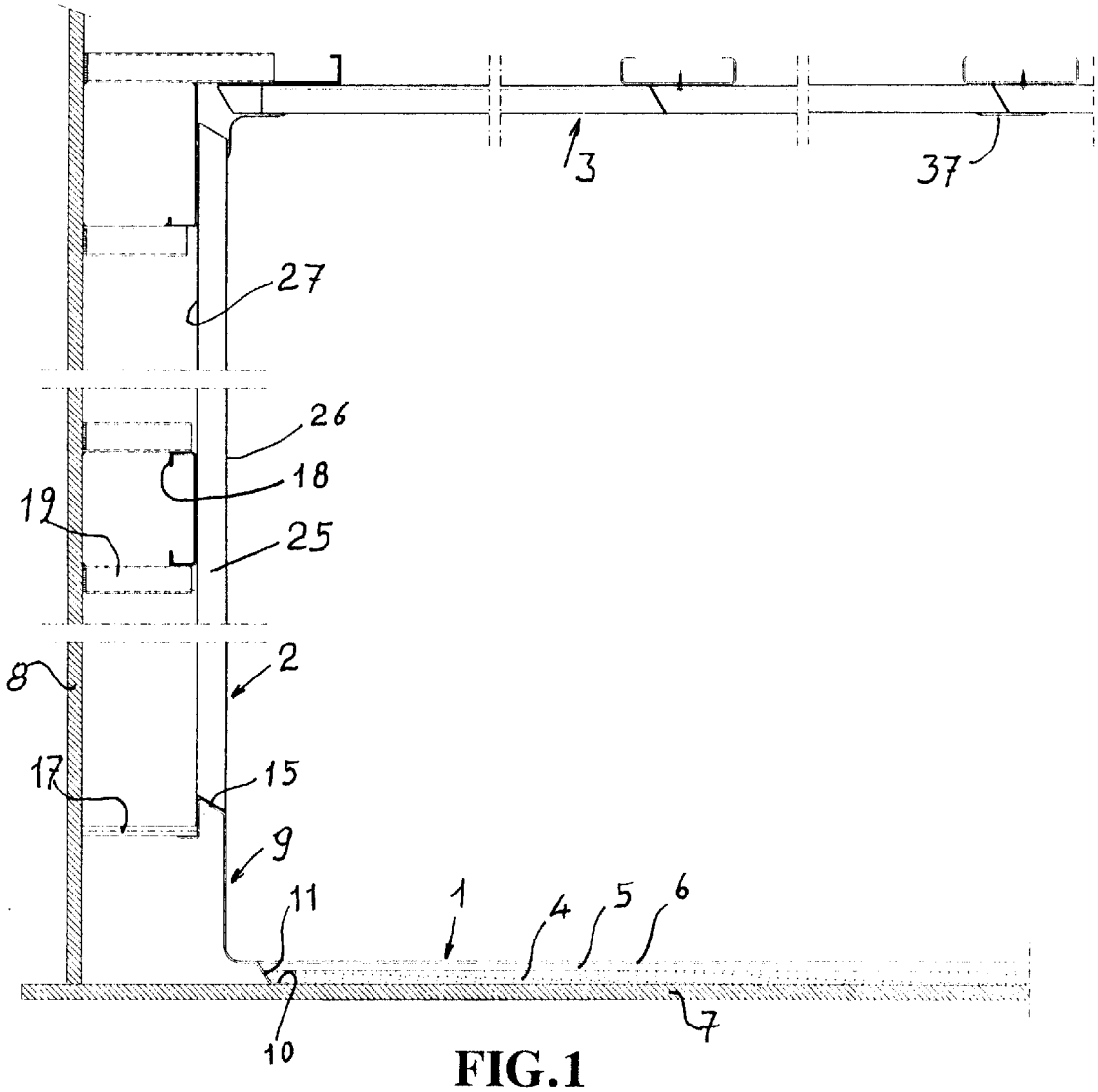
FIG. 1 shows a schematic vertical cutaway view of a structure mounted according to this invention, with external panels only.

FIG. 1 is a vertical assembly cutaway view of a structure mounted according to this invention, featuring how the resin flooring 1 is assembled to a wall 2 and a ceiling 3 inside a deck plate 7 and a bulkhead 8.

The drawing shows that the flooring 1 consists of three layers: the floor foundation 4, the decorative finishing coat 5 and the transparent resin topping 6, whereas the final protective antiscratch and antiwear layer is not shown.

Figure 11:
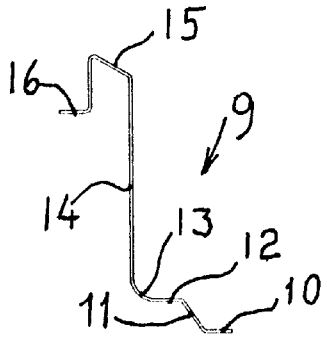
FIG. 11 shows the profile of a coaming in vertical cutaway view.

The coaming 9, more clearly illustrated in FIG. 11, is glued with its lower horizontal edge 10 to the deck plate 7.

The profile of the coaming 9 continues with a flap 11 having a 45° inclination and the same height as planned for the flooring 1, which flap 11 will be properly treated so as to improve its adhesion to the flooring 1.

After a short horizontal length 12, matching the corner 13, the profile is rounded off to facilitate later cleaning of the rooms.

The coaming profile 9 than follows a sufficiently long vertical path 14 to prevent any infiltration. At its upper end, the coaming 9 terminates with a sloping edge 15 so that any moisture formed oil the wall 2 will not enter the hollow space between the wall 2 and the bulkhead 8, but will enter the room.

On its rear side, the coaming 9 has a horizontal rim 16 to be fastened with suitable elements 17 to the bulkhead 8.

Figure 25:
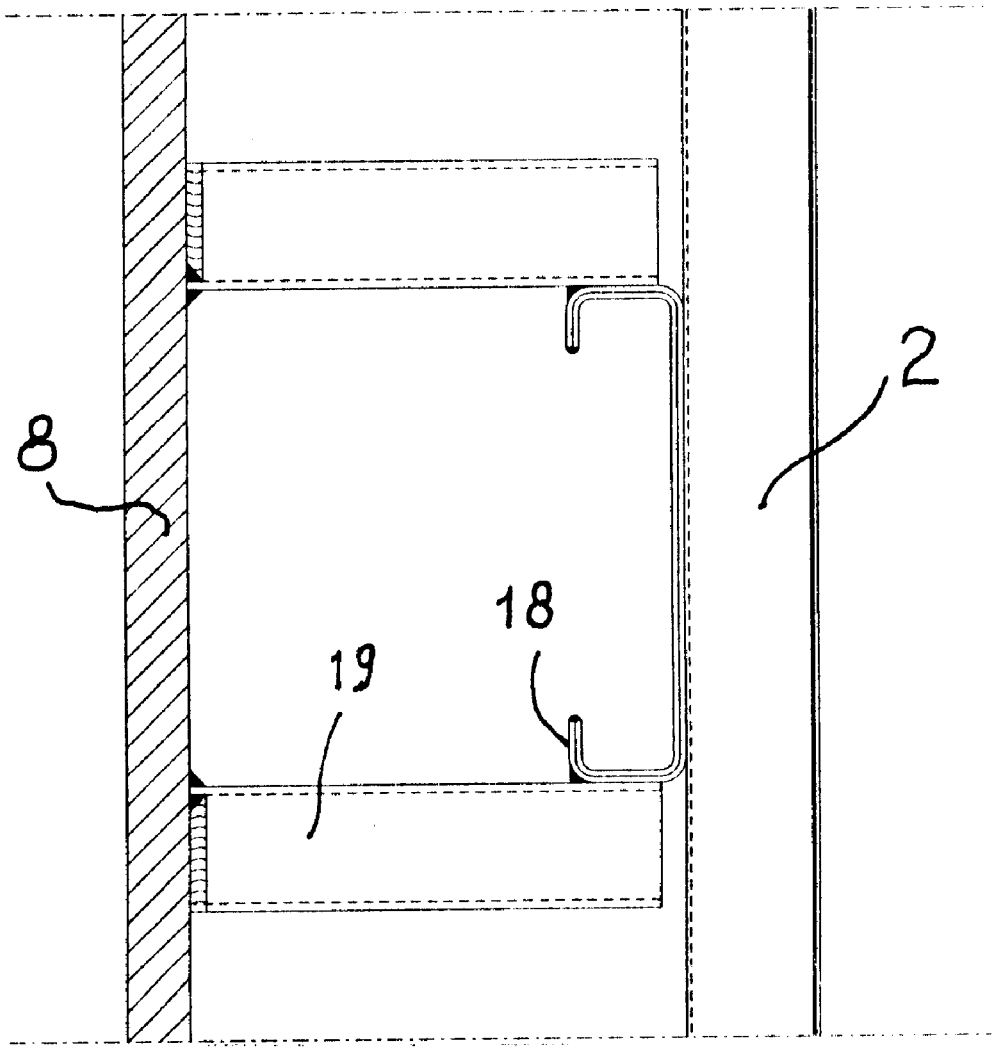
FIG. 25 shows a detail of FIG. 1 featuring the fastening of a panel to the rear bulkhead.
Figure 27:
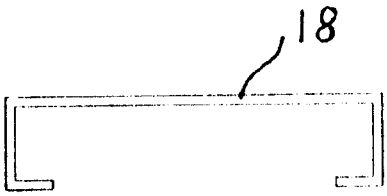
FIG. 27 shows the cutaway view of a C-shaped element to fasten the wall of the structure to the supporting brackets.

The panels 25 forming the wall 2 on which the C-shaped elements 18 shown in FIG. 27 are glued, are placed on the coaming 9, the panels 25 being secured to the bulkhead 8 by supporting brackets 19 in galvanized steel as shown in detail in FIG. 25.

Figure 2:
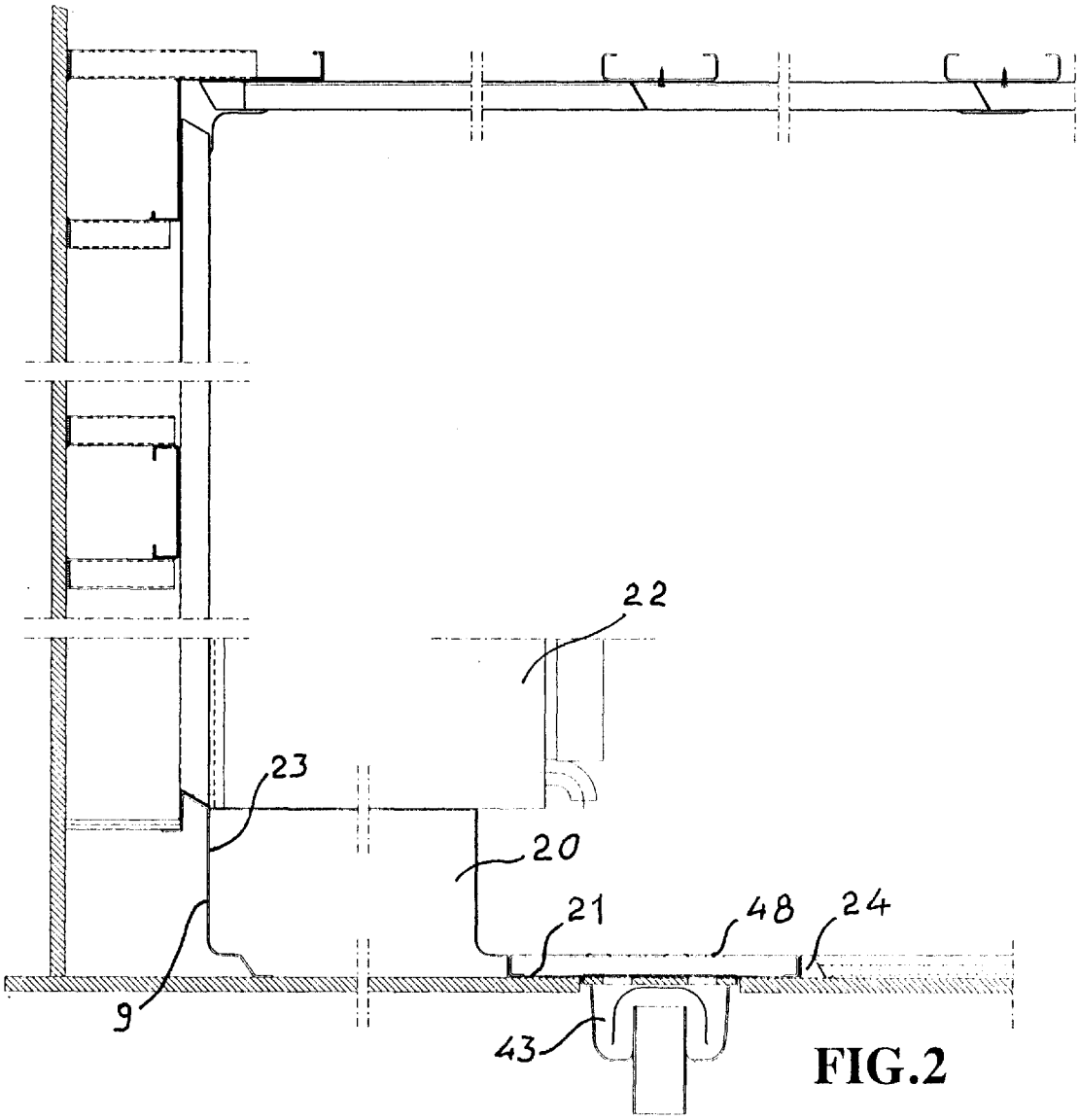
FIG. 2 shows a schematic vertical cutaway view of a structure mounted according to this invention, with a box shaped seating and drain channel; the box shaped seating and drain channel being adjacent to the coaming.
Figure 26:
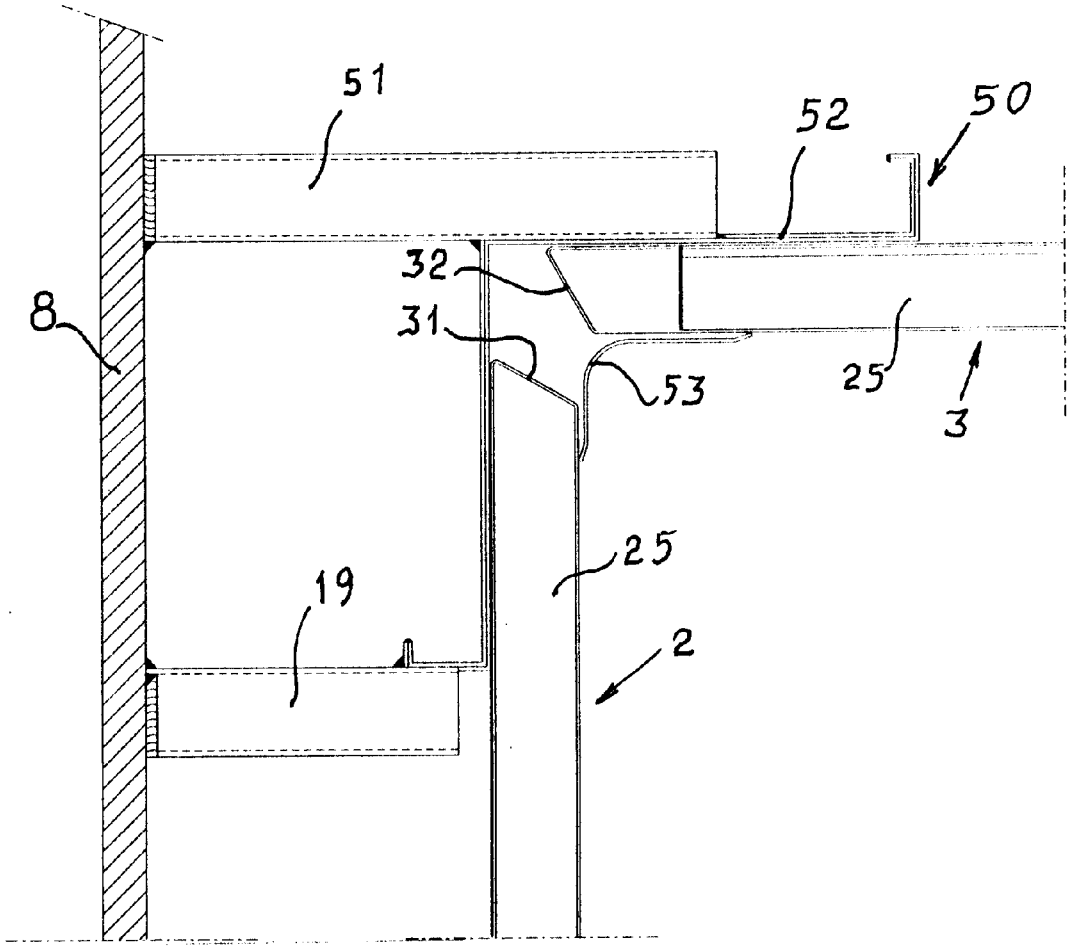
FIG. 26 shows a detail of FIG. 1 featuring the corner fastening of the structure to the rear bulkhead
Figure 28:
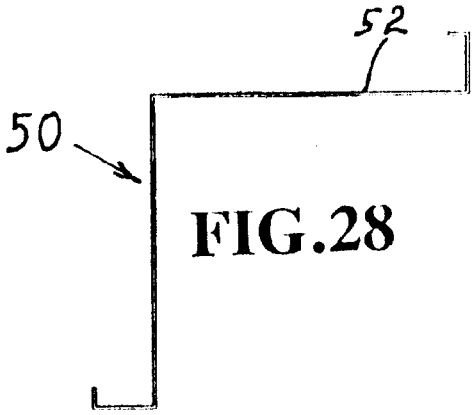
FIG. 28 shows the cutaway view of a fastening element to secure the corner of the structure to the rear bulkhead.
Figure 30:
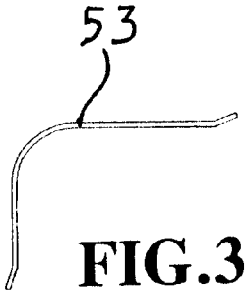
FIG. 30 shows the cutaway view of an internal finishing angle section between wall and ceiling, where the structure is secured to the rear bulkhead and the deck above.

At the top, the corner of the structure is fastened in the same way to the rear bulkhead 8 and to the upper deck (not shown in the figure), by means of special sections, better illustrated in FIG. 26, 28 and 30. FIG. 2 is similar to FIG. 1 showing a box shaped seating 20 with built-in drain channel 21, better illustrated in FIG. 15 and 16. A piece of furniture 22 is mounted on the box shaped seating 20.

The box shaped seating 20 in FIG. 2 is shown adjacent to the coaming 9 and its profile 23 in direction of the coaming 9, is complementary to the profile of the coaming 9 and coincides with the latter. In the direction of the drain channel 21, forming one single block with the box shaped seating 20, the profile needs no further sloping flap, since at this point it does not hold the flooring.

To ensure the continuity of the coaming and allow for a later modification, the box shaped seating 20 is approached to the coaming 9, without being an integral part of it.

The box shaped seating 20 is closed all around and is directly glued onto the deck plate 7 wherever its horizontal sections are in touch with the deck plate 7.

When the box shaped seating 20 is adjacent to the coaming 9, it is tack-welded to the coaming 9 and scaled with an bonding agent.

Figure 15:
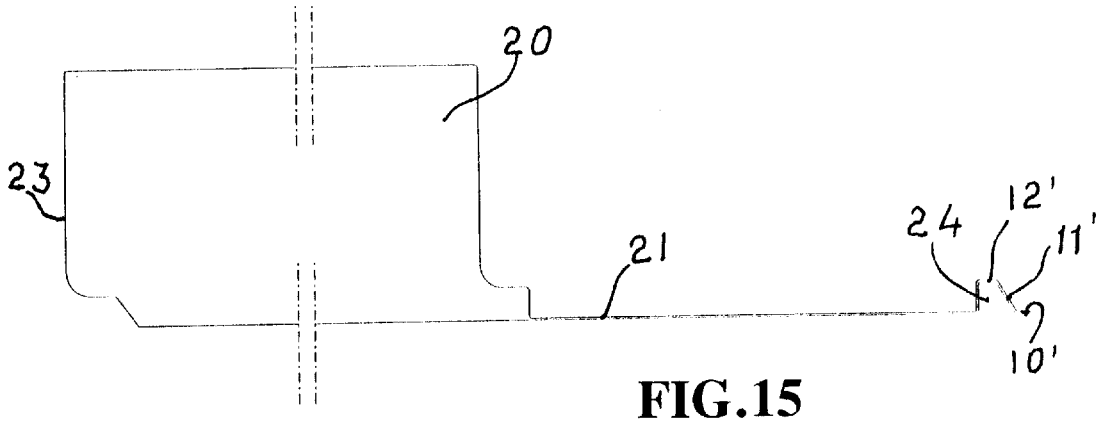
FIG. 15 shows a vertical cutaway view of a box shaped seating with a drain channel.

At the opposite end 24 of the drain channel 21 where it meets the flooring, the profile once more takes the shape of the coaming, as indicated by 10', 11', 12' (cf FIG. 15).

Figure 3:
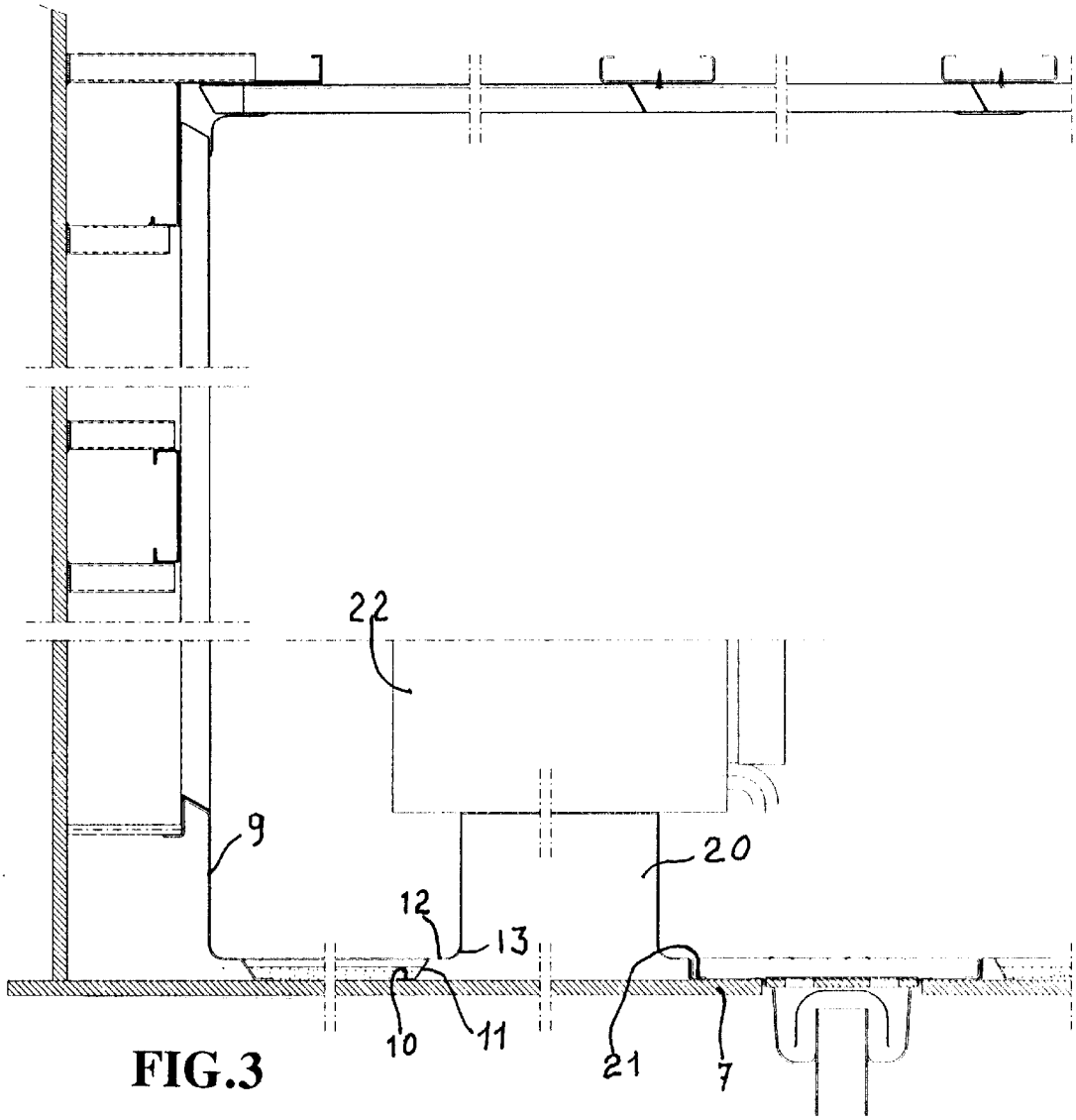
FIG. 3 shows a schematic vertical cutaway view of a structure mounted according to this invention, with a box shaped seating and drain channel; the box shaped seating and drain channel being isolated from the coaming.

FIG. 3 shows a cutaway view similar to FIG. 1, in which the box shaped seating 20 with drain channel 21 is isolated from the coaming 9. The box shaped seating 20 is still closed and where a drain channel 21 is lacking, the profile at the foot has the same profile as the coaming, in 10, 11, 12, 13.

Figure 4:
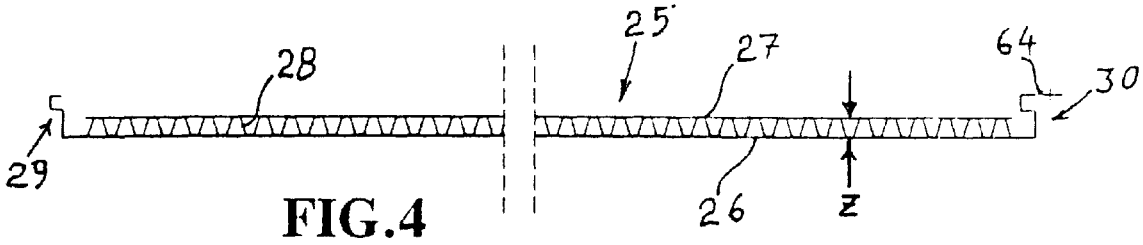
FIG. 4 shows a horizontal cutaway view of a typical panel of the structure.

FIG. 4 shows the horizontal cutaway view of a panel 25 of the structure.

It is a sandwich panel formed by an external stainless steel plate 26, i.e. as seen from inside the room, a galvanised plate 27 on the opposite side, i.e. towards the hollow space between the wall 2 and the bulkhead 8, whereas a corrugated or Z-type aluminium sheet 28 is inserted between the two plates.

According to a preferential implementation, the stainless steel plate 26 has a thickness of 8/10 mm, the galvanized plate 27 has a thickness of 6/1\0 mm and the internal aluminium corrugated sheet 28 has a thickness of 0.3 mm and the height of the Z=15 mm.

The product known under the trade name DOLUFLEX may be used for this internal corrugated aluminum sheet 28.

Figure 5:
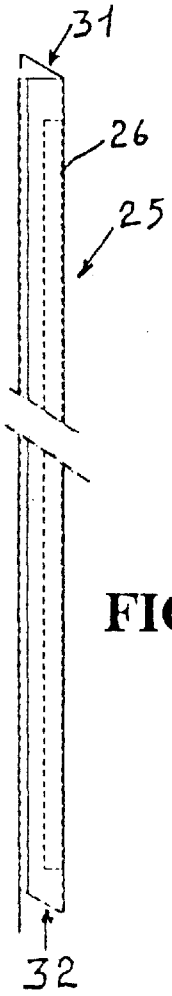
FIG. 5 shows a vertical cutaway view of a typical panel.

FIG. 5 shows a vertical cutaway view of the panel 25.

At its edges 29, 30, 31, 39, the panel 25 terminates with the properly flanged stainless steel plate 26 only.

The shape of the stainless steel plate 26 along its edges is essential for fitting the panels 25 together, which is achieved by positioning and glueing the stainless steel plate 26, while its rear parts 27 and 28 remain unrestrained by edges and independent.

The dimensions of the panel 25 may vary according to need; the panel is rectangular, usually sized 2×0.9 m with its longer leg placed vertically.

The two edges 29 and 30 of the longer legs, shown in FIG. 4, are complementary for perfect assembly of adjacent panels.

As illustrated in FIG. 4, the two edges 29, 30 form a tooth obtained by four 90° bends.

The two edges 31 and 32 of the shorter legs of the panels, shown in FIG. 5, have their stainless steel plate 26 flanged backwards at the same inclination as the sloping edge 15 of the coaming. As a matter of fact, the lower edge 32 will be perfectly resting and matching upon installation on the sloping edge 15 of the coaming.

Figure 6:
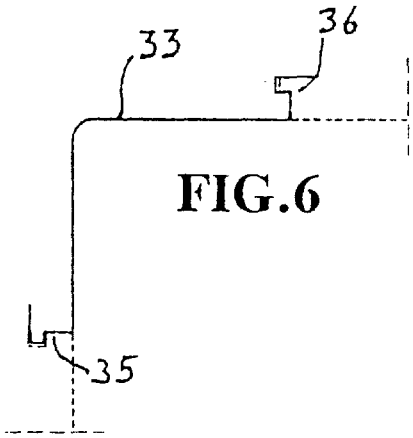
FIG. 6 shows a jointing element at interior angle of a panel.

FIG. 6 shows a jointing element 33 in stainless steel connecting two adjacent panels 25, when the wall 2 forms an interior angle at horizontal plan. The plate is radiused at the apex of this angle to facilitate cleaning. The two terminal edges 35, 36 of the element 33, as well as the edges 29, 30 are complementary to ensure a perfect fit with the panels 25.

Figure 7:
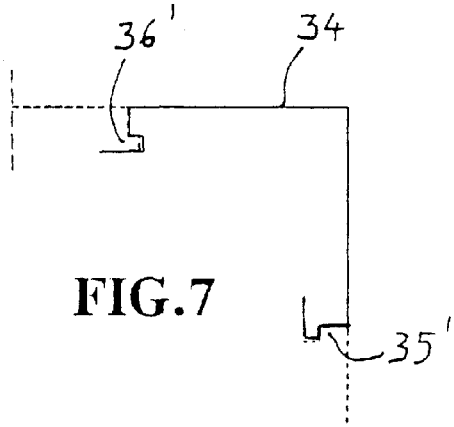
FIG. 7 shows a jointing element at the outer corner of a panel.

FIG. 7 shows a similar jointing element 34 to be used to match an outer corner of the wall 2. The two terminal edges 35' and 36' of the element 34, are complementary like the edge 29 and 30 to ensure a perfect fit with the panels 25.

No radiusing is needed for the outer corner since it can easily be cleaned even at 90°, because it is in evidence. All the same, being a flanged plate, the edge will never be sharp.

The elements 33 and 34 are not sandwich type but are simple plates since they are sufficiently rigid to be self-bearing and strengthened by their bending. They are sized approximately 150×150 mm.

Figure 8:
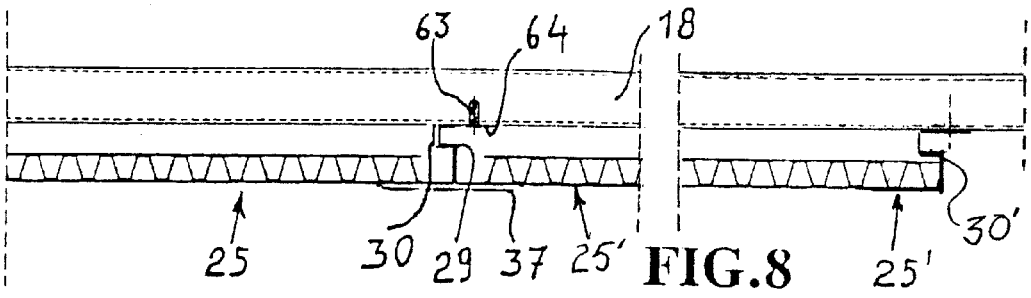
FIG. 8 shows the assembly of two panels.

FIG. 8 shows in horizontal cutaway view, the assembly of the two panels 25 and 25' of the wall 2. The two sections are restrained and the edges 29, 30 ensure a perfect fit. At the rear, one flap of the edge 30 of the panel 25 is connected to a supporting C-shaped element 18. The panel 25 is fastened by a screw 63 connecting the protruding flap 64 of the edge 30 to the element 18, while the shaped edge 29 of the adjacent panel 25' is restrained in the edge 30 of the panel 25 so that this restrained joint guarantees fastening. However, the panel 25' will be better blocked with a screw by securing its edge 30' at its other end to another element 18 so as to block the panel 25' at both ends.

At their lower end, the panels 25 are secured to the coaming 9, while they are fastened at the rear to the C-shaped elements, usually in two intermediate points of the panel 25.

If the two panels are not perfectly flush jointed, a butt strap 37 is applied having only the aim to cover the gap.

On the ceiling 3, it is preferable simply to fit the panels side by side, without restraint, as shown in FIG. 1, so as to prevent important misalignments in the corners.

Figure 9:
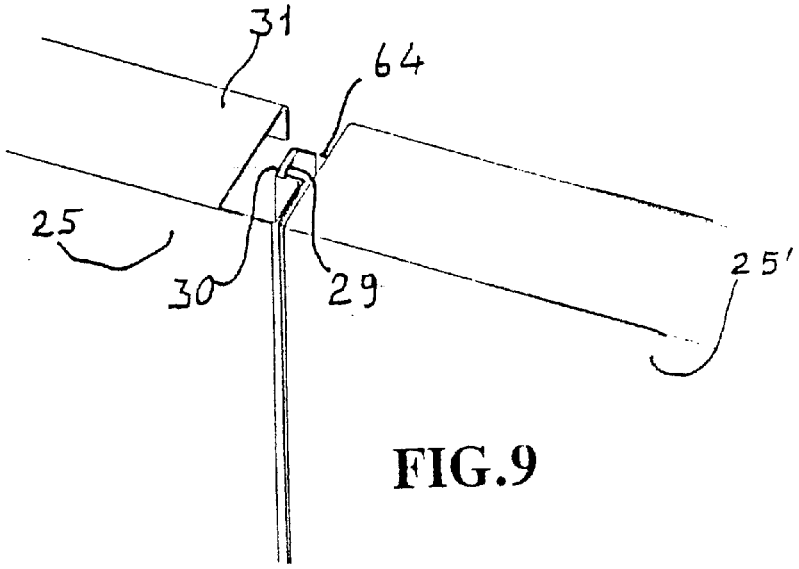
FIG. 9 shows a perspective view of a detail in FIG. 8.
Figure 10:
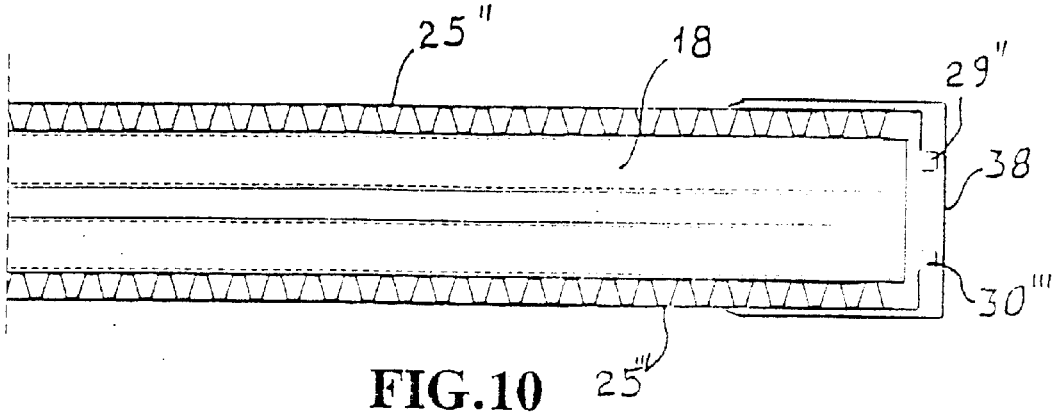
FIG. 10 shows a horizontal cutaway view of a double wall.

FIG. 9 shows a perspective view of a detail of the assembly shown in FIG. 8 at the upper end of the panels where the upper flap 31 is flanged. FIG. 10 shows a horizontal cutaway view of a double wall consisting of two separate panels 25" and 25'" of a vertical wall united by a prefabricated element 38. This double wall 25", 25'" is used as a partition between two rooms without the support of intermediate bulkheads 8. The prefabricated element 38 which closes the walls 25", 25'" at the ends is in stainless steel plate of uniform thickness. The edges 29", 30'" of the stainless steel plate of the walls 25", 25'" are properly flanged at the ends to obtain a sturdier structure.

Figure 12:
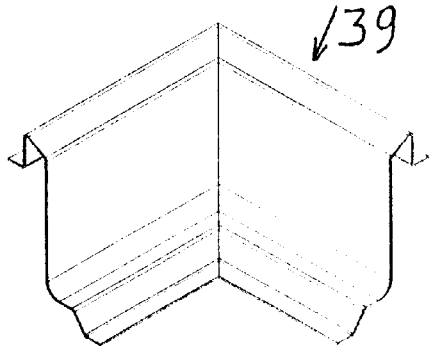
FIG. 12 shows a perspective view of a coaming cutaway view, to be used in relation to an interior angle of the perimeter.
Figure 14:
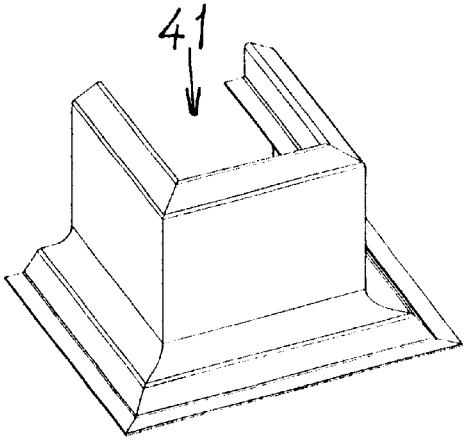
FIG. 14 shows a perspective view of a coaming cutaway view, to be used at double wall.
Figure 13:
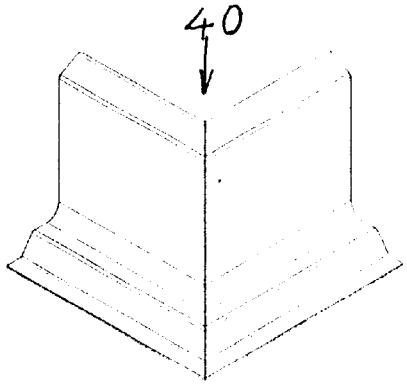
FIG. 13 shows a perspective view of a coaming cutaway view, to be used in relation to an outer corner of the perimeter.

FIG. 11 shows a vertical cutaway view of the profile of a coaming 9. The FIGS. 12, 13 and 14 are prefabricated details of the coaming and are used in special cases. The coaming component 39 shown in FIG. 12 is used for an interior angle of the perimeter.

The coaming element 40 in FIG. 13 is used in correspondence of an outer corner of the perimeter.

The coaming element 41 shown in FIG., 14 is used whenever a double wall 25", 25'", will be erected.

Figure 16:
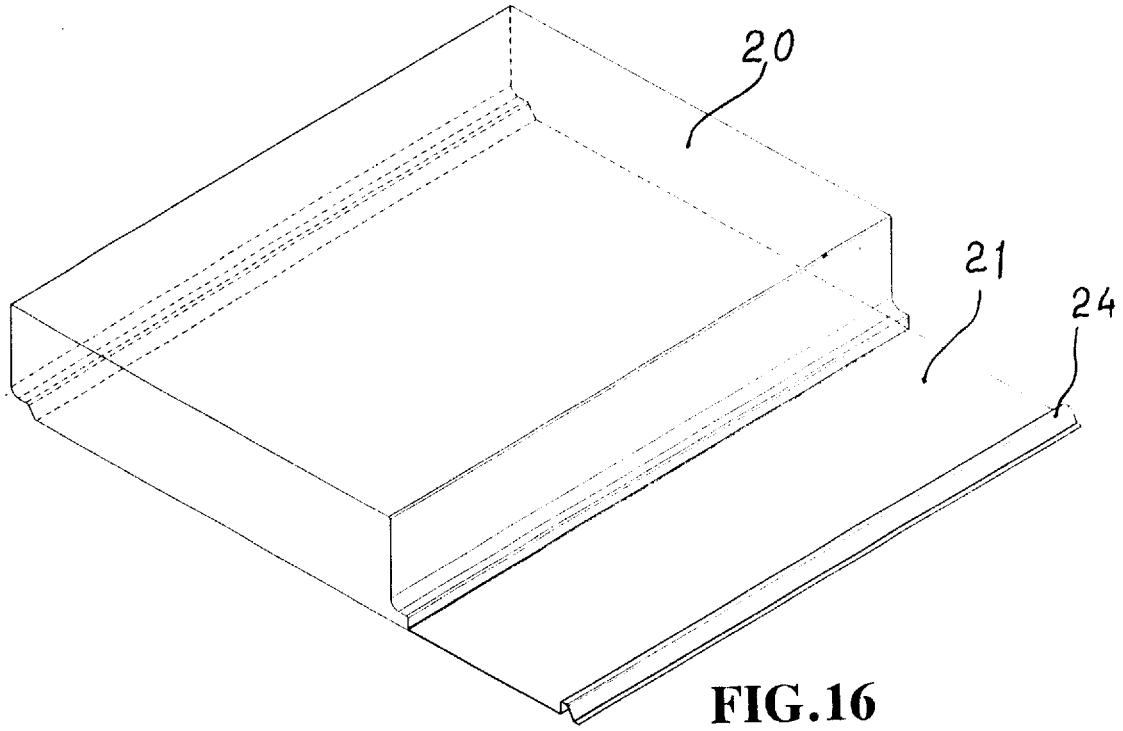
FIG. 16 shows a perspective view of a box shaped seating with drain channel.

The FIGS. 15 and 16 show a box shaped seating 20 with built-in. drain channel 21. This box shaped seating 20 is open only at the base i.e. at its lower end which will be closed by and sealed with the deck plate.

Figure 17:
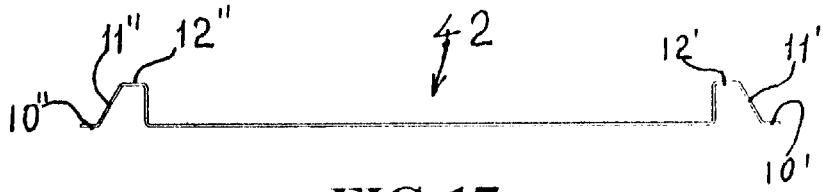
FIG. 17 shows a vertical cutaway view of a drain channel.
Figure 20:
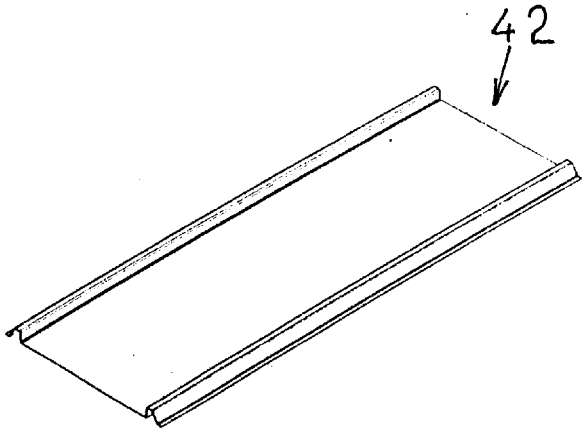
FIG. 20 shows a perspective view of straight length of the drain channel.

FIG. 17 shows a vertical cutaway view of a isolated drain channel 42 as illustrated in perspective view in FIG. 20. The drain channel is supplied with its completed closed lower surface. Since the scupper 43 (cf. FIG. 2) has been previously fitted on the deck plate, it would be rather critical to let a hole previously bored in the drain channel 42 coincide exactly with the scupper. It is therefore preferable to determine the exact position of the scupper after the drain channel 42 has been positioned and only then drill the hole in the drain channel 42 in exact correspondence with the scupper 43 which is then welded in its correct position.

In the case of the isolated drain channel 42, both edges have the same profile 10', 11', 12', 10", 11", 12" as the coaming 9, both lengths 11' and 11" sloping outwards.

Figure 18:
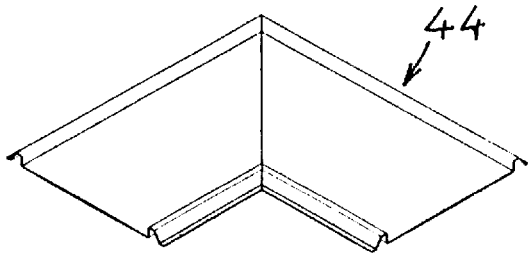
FIG. 18 shows a perspective view of an L-shaped drain channel cutaway view.
Figure 19:
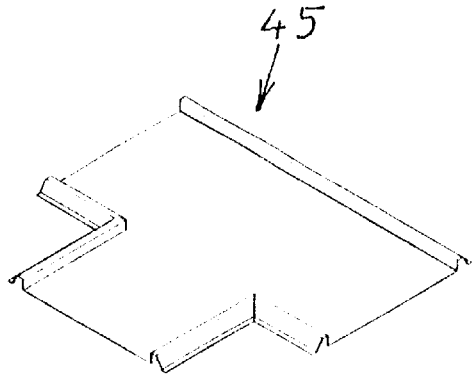
FIG. 19 shows a perspective view of a T-shaped drain channel cutaway view.

Since the drain channel shall follow any branch lines along an angular path, prefabricated standard elements will be supplied with 90° angles, for example L shaped 44 as shown in FIG. 18 or T-shaped 45 as shown in FIG. 19.

Figure 21:
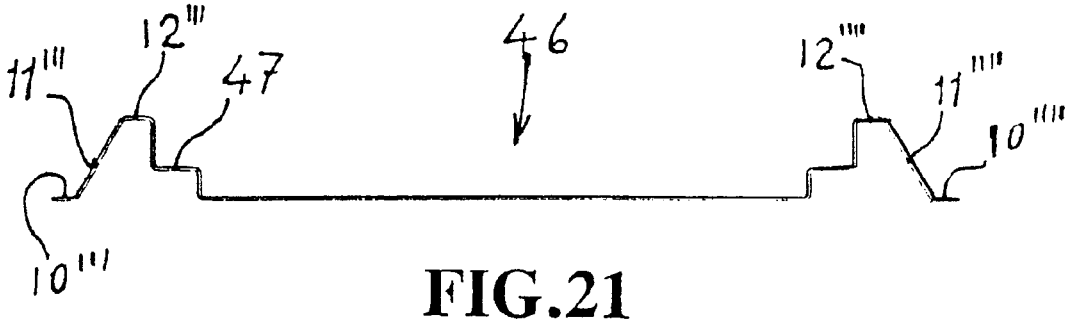
FIG. 21 shows a vertical cutaway view of a deeper drain channel.
Figure 22:
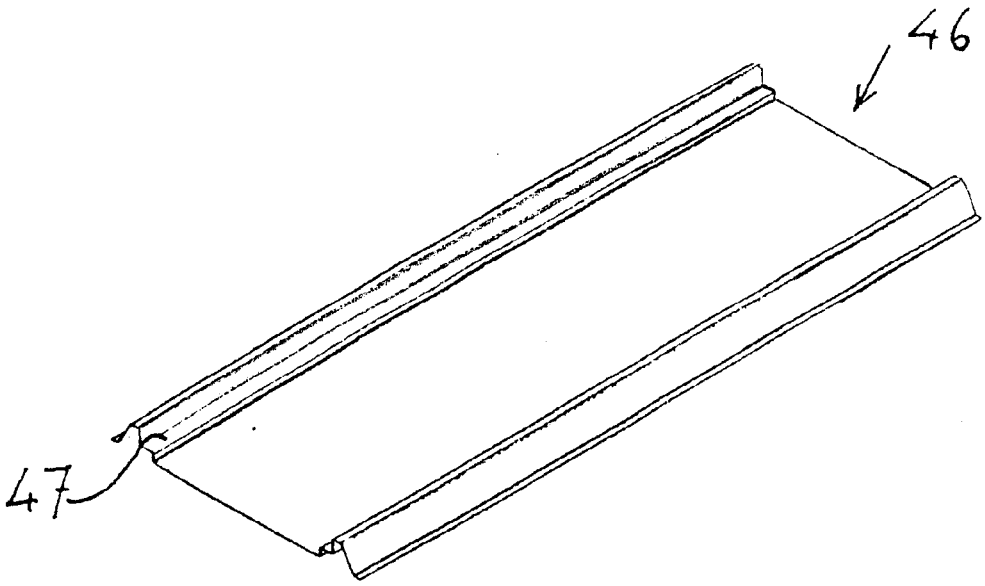
FIG. 22 shows a perspective view of a straight deeper drain channel.

The possibility to collect a greater water volume may sometimes be useful, In such case a deeper drain channel 46 as shown in the FIGS. 21 and 22 may be used. The shape of the outer edge will be the same, only deeper, with the features 10'", 11'", 12'", 10"", 11"", 12"", whereas the inner depth increases thanks to a step 47, Obviously it will be necessary also to increase the thickness of the resin flooring and this implementation and laying will be more expensive and take more time. It will also increase the weight of the flooring.

As an alternative, a hole might be drilled in the deck plate at drain channel level, but the deck plate should then be reinforced so as not to disturb the steel structure of the ship and this solution may be adopted in the vicinity of some special users.

Figure 23:
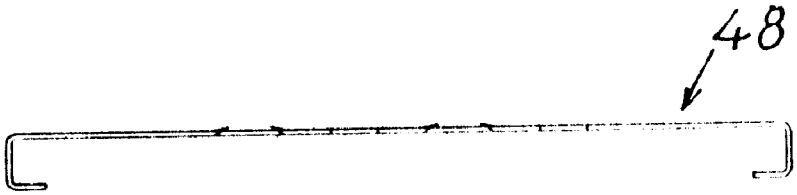
FIG. 23 shows a vertical cutaway view of a drain channel cover.
Figure 24:
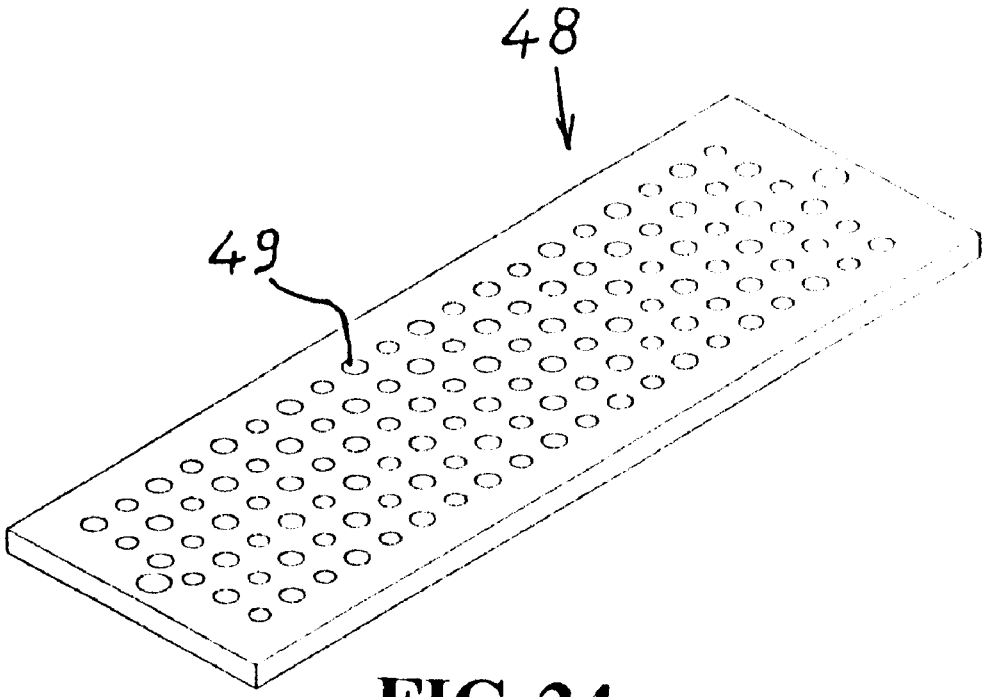
FIG. 24 shows a perspective view of a drain channel cover.

The FIGS. 23 and 24 show a vertical cutaway view and a perspective of a drain cover 48 which is laid on the drain channels 21 or 42 as a cap. It is fabricated in 3 mm thick stainless steel plate, normally in 300 mm elements. It has no rivets or other accessories and is only obtained by bending and punching the holes 49 through which the liquids enter the drain channel 21 or 42.

FIG. 25 shows in detail how the panel 2 is fastened to the rear bulkhead 8 or onto the deck located above. C-shaped galvanized steel elements 18 are screwed or glued at the back of panel 2, since welding on stainless steel should be avoided. A cutaway view of the element 18 is shown in FIG. 27.

Each C shaped element 18 is welded to two, normally U or L shaped supporting brackets 19 in galvanized steel, which in turn, are welded onto the bulkhead 8 or to the deck above, as shown in the figure. In this way, secure fastening of the panels is guaranteed.

FIG. 26 shows how the wall 2 and the ceiling 3 are comer-fastened to the rear bulkhead 8. In this corner, a special fastening element 50 is used, separately illustrated in FIG. 28, consisting of two C-shaped elements cut and welded together at 90°. Actually it consists of a single prefabricated and properly flanged element.

To ensure that the supporting bracket 51 will overlap the horizontal arm 52 of the fastening element 50, the supporting bracket 51 will be longer than the bracket 19.

An L-shaped finishing section 53 will be mounted inside the wall-ceiling corner as separately shown in FIG. 30, The section 53 which is prefabricated in commercial lengths of 2 m will round off any sharp edges between the wall and ceiling, in compliance with the Regulations in force.

FIG. 26 shows the flanged edges 31 and 32 at the ends of the short legs of the panel 25.

Figure 29:
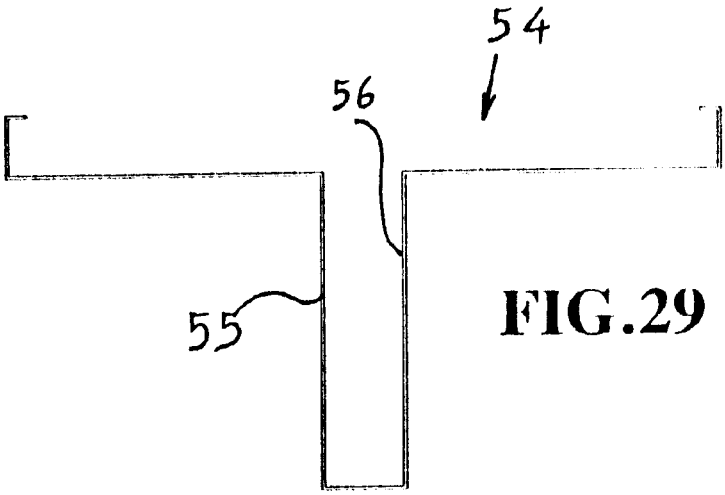
FIG. 29 is a cutaway view of a section to be secured to the deck above at a double wall.

FIG. 29 shows a vertical cutaway view of the T-shaped section 54, to be used to fasten a double wall 25" 25'" to the deck above. This section 54 is virtually a doubled element of section 50. Each of the two 25" and 25'" panels is externally approached to the corresponding side 55 and 56 of the stem of the T-shape. The section 54 thus connects the ceiling of two adjacent rooms.

Figure 31:
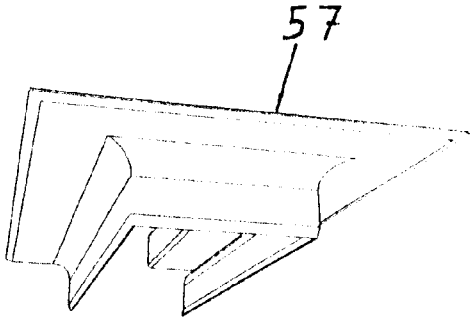
FIG. 31 shows a perspective view of an internal finishing angle section to be used for double walls.
Figure 32:
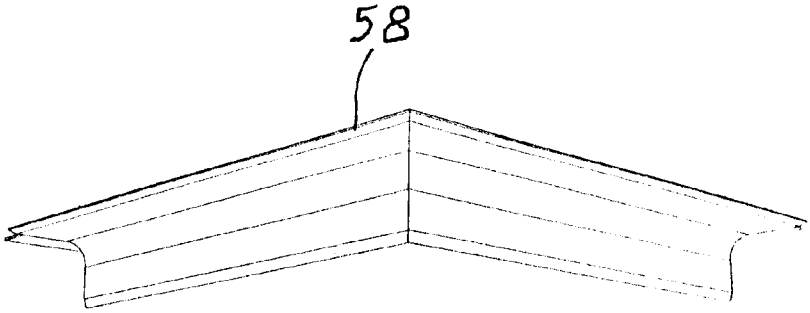
FIG. 32 shows a perspective view of an internal finishing angle section to be used in a wall angle.
Figure 33:
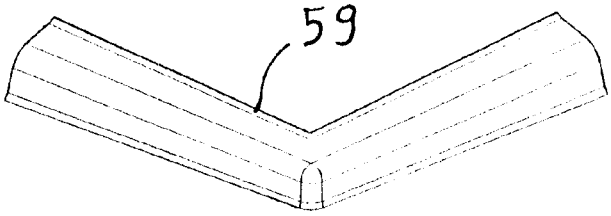
FIG. 33 shows a perspective view of an internal finishing angle section to be used along a wall corner.

The FIGS. 31, 32, 33 show a perspective view of prefabricated internal finishing sections 53, respectively 57, 58 and 59 to be used in particular cases.

FIG. 31 shows a finishing section 57 to be used for a double wall 25", 25'".

FIG. 32 shows a finishing section 58 to be used for an interior angle of the panels 25.

FIG. 33 shows a finishing section 59 to be used for an outer corner of the panel perimeter 25.

Figure 34:
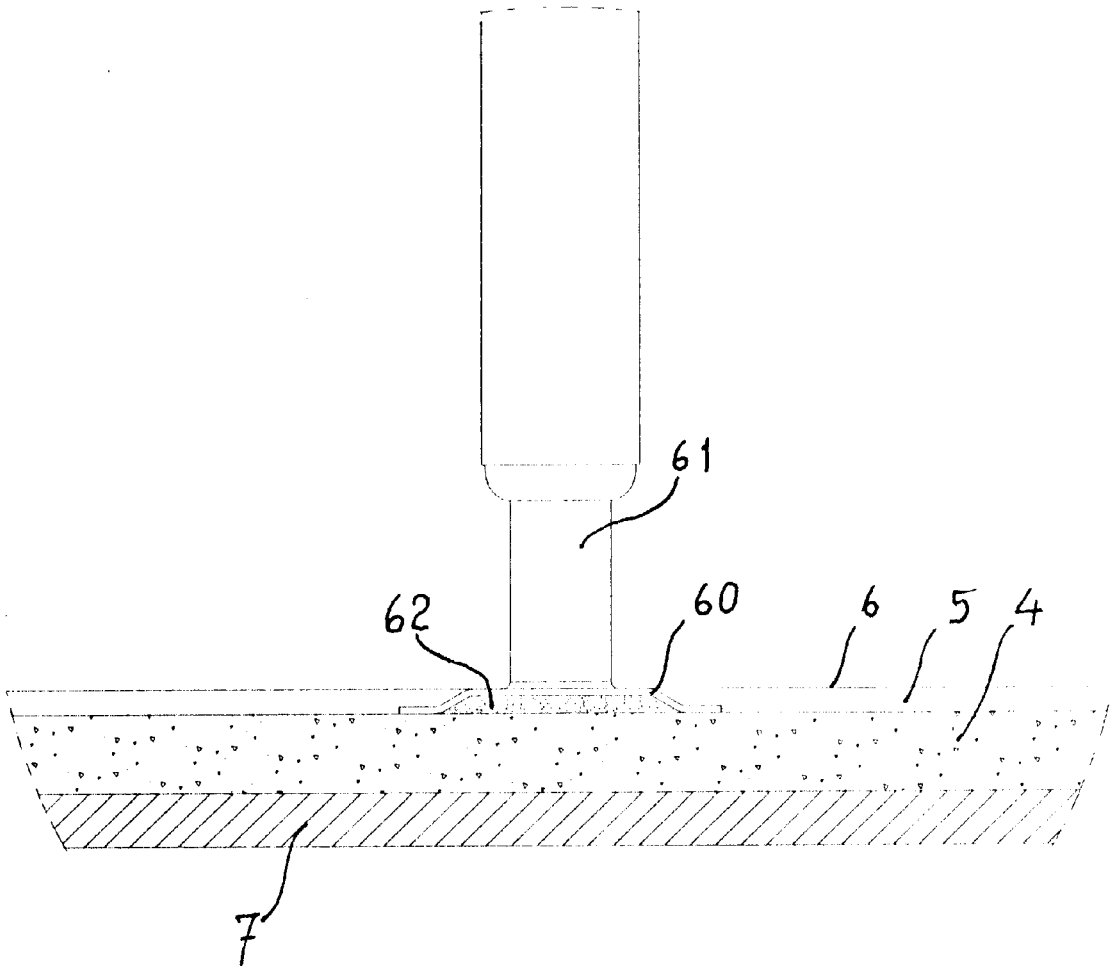
FIG. 34 shows how a foot is secured to the floor.
Figure 35:
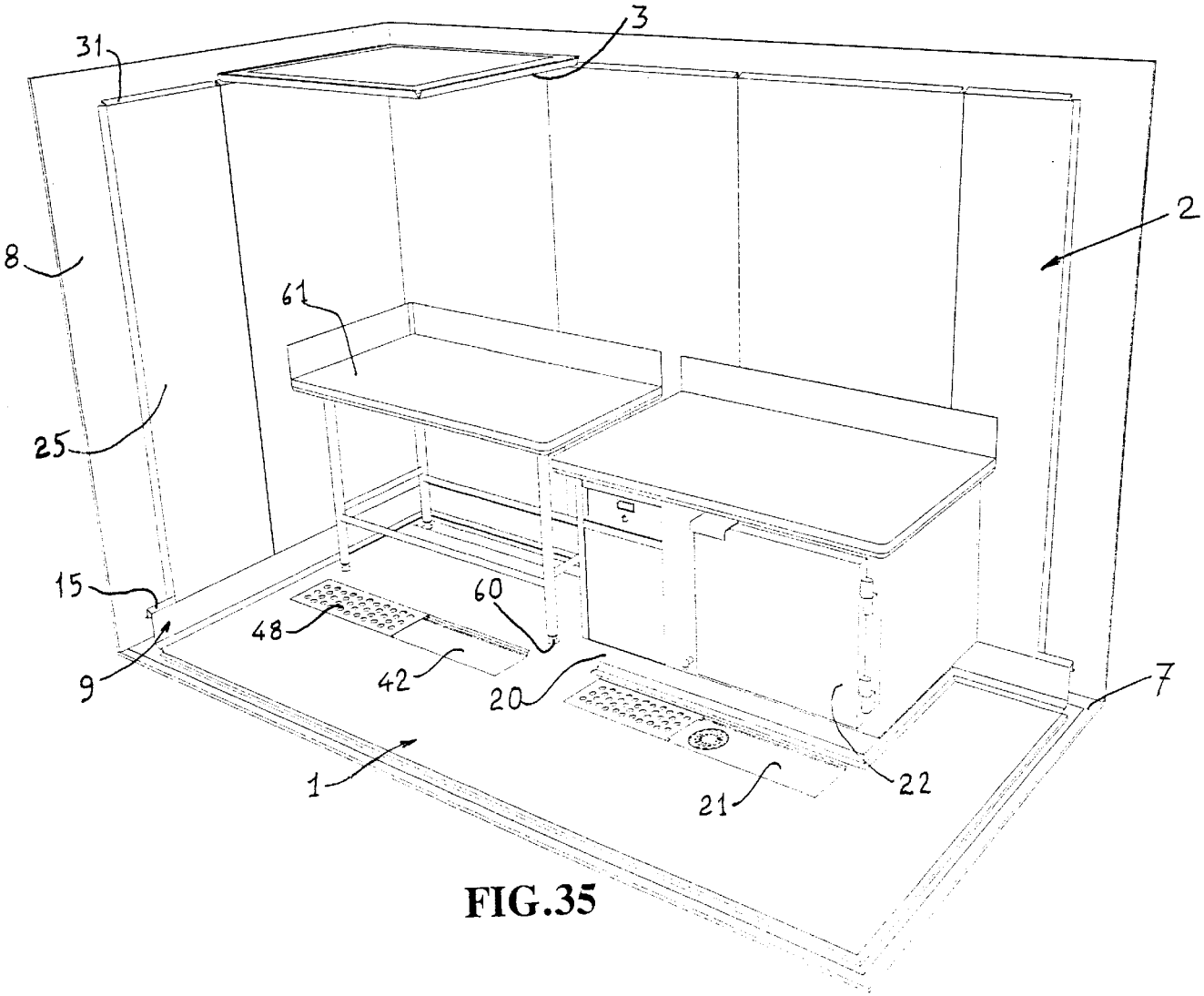
FIG. 35 shows a perspective general view of a room covered with the structure subject matter of this invention.

FIG. 34 shows how the foot 60 of a furnishing element 61 is secured to the flooring.

If the lower side of furnishing elements is open as in the case of tables, no box shaped seatings 20 previously glued to the deck plate 7 are used to secure them to the flooring, but the foots 60 are secured to the floor foundation 4 during the flooring laying operation. FIG. 34 shows the foundation 4, the finishing coat 5 and the thin transparent resin topping 6 applied to the deck plate 7. The foot 60 is glued on the floor foundation 4 with structural bonding agent 62 applied into the hollow cavity below the foot 60. The foot 60 is then embedded and partially covered by the finishing coat and resin topping.

This invention includes any and all variations of the details and modifications deemed obvious by technicians of the branch, which don't lie outside the scope of this invention but are included in the following claims.

What is claimed is:

1. Appropriate fitting-out structures for moist rooms which include a deck plate or sub structure (7), a bulkhead (8) and an upper deck, said fitting-out structures comprising:

a) a coaming (9) extending from said deck plate (7) to a wall (2), said coaming having a profile including a lower horizontal edge (10) glued to said deck plate and extending with a 45° upward sloping flap (11), a short horizontal length (12), a rounded off corner (13), a vertical path (14) terminating in an upwards sloping edge (15) having a rim (16) at the rear thereof directed towards said bulkhead;

b) a flooring (1) formed of a floor-foundation (4), a decorative finishing coat (5), a transparent resin topping (6) and a protective anti-scratch and anti-wear blanket, said flooring covering said deck plate to overlap said horizontal edge (10) of said coaming to the height of said flap (11) of said coaming;

c) at least one panel (25) forming said wall (2) and a ceiling (3) having a stainless steel facing plate (26), a galvanized back plate (27), and a corrugated aluminum sheet (28) inserted between facing plate (26) and back plate (27), said panel (25) having first two opposing edges (29, 30) formed by flanges of said facing plate (26) suitably shaped to connect adjacent panels (25) and second two opposing edges (31, 32) being complementary wherein one of said second two opposing edges is suitable for positioning on said coaming (9);

d) galvanized steel C-shaped elements (18) glued to the back plate (27) of said panel (25) and secured at the rear to said bulkhead by means of first supporting brackets (19); and e) galvanized steel corner fastening elements (50) glued to back plates (27) of perpendicularly adjacent panels (25) forming a wall-ceiling corner of the moist rooms secured to said bulkhead by means of second supporting brackets (51).

2. Appropriate fitting-out structures as defined in claim 1, which further includes at least one box shaped seating (20) and at least one drain channel (21, 42, 46) directly glued to said deck plate (7).

3. Appropriate fitting-out structures as defined in claim 2, wherein said at least one box shaped seating (20) is closed on all sides having a lower profile including a lower horizontal edge (10) glued to said deck plate and extending with a 45° upward sloping flap (11), a short horizontal length (12) and a rounded off corner (13).

4. Appropriate fitting-out structures as defined in claim 2, wherein said at least one drain channel is stainless steel with a completely closed lower surface and an edge profile including a lower horizontal edge (10', 10") glued to said deck plate and extending with a 45° upward sloping flap (11', 11") and a short horizontal length (12', 12") wherein said sloping flap slopes outwardly.

5. Appropriate fitting-out structures as defined in claim 4, wherein said at least one drain channel (46) has a greater depth formed by an inside step (47) on the inside thereof.

6. Appropriate fitting-out structures as defined claim 2, wherein said at least one drain channel is provided with a drain cover (48) formed by bending and punching a preferably 3 mm thick stainless steel plate.

7. Appropriate fitting-out structures as defined in claim 2, wherein said at least one box shaped seating (20) includes a built-in drain channel (21) and is arranged adjacent to said coaming (9) with a profile (23) complementary to the profile of said coaming, and wherein the opposing side (24) of said box shaped seating where it meets the deck plate (7) has the same shape as said coaming.

8. Appropriate fitting-out structures as defined in claim 2, wherein said at least one box shaped seating (20) includes a built-in drain channel (21) and is isolated from said coaming.

9. Appropriate fitting-out structures as defined in claim 1, wherein said first supporting brackets (19) are formed of galvanized steel.

10. Appropriate fitting-out structures as defined in claim 1, wherein the first two opposing edges (29, 30) of said panel (25) are complementary and form a tooth obtained by four 90° bends, and wherein the second two opposing edges (31, 32) have the facing (26) flanged backwards with the same inclination as the sloping edge (15) of said coaming.

11. Appropriate fitting-out structures as defined in claim 1, wherein said facing plate (26) has a thickness of 0.8 mm, said back plate (27) has a thickness of 0.6 mm and the internal corrugated aluminum sheet (28) has a thickness of 0.3 mm, a Z-shape of said corrugated sheet having a height of 15 mm, and the panel (25) has a 2×0.9 m rectangular shape with the longer edge arranged vertically.

12. Appropriate fitting-out structures as defined in claim 3, wherein the upward sloping flap of said coaming and upward sloping flap of said box shaped seating are covered with bonding agent consisting of a single component polyurethane-based product and the floor foundation (4) consists of a two component epoxy-polyurethane based product with a foamed micro cellular aluminate filler, the finishing coat (5) consists of a two-component polyurethane based resin, said finishing coat (5) is covered by a transparent polyurethane based resin topping (6) in which anti-slip granules are incorporated and to which a special transparent acrylic-silicone based anti-scratch and anti-wear protecting topping is applied.

13. Appropriate fitting-out structures as defined claim 3, wherein the upward sloping flap of said coaming and the upward sloping flap of said box shaped seating are pretreated with adhesion boosters consisting of a xylane-based two-component compound, and the floor foundation (4) consists of a two-component epoxy-polyurethane based product with a foamed micro cellular aluminate filler, the finishing coat (5) consists of a two-component polyurethane based resin, said finishing coat (5) is covered by a transparent polyurethane based resin topping (6) in which anti-slip granules are incorporated and to which a special transparent acrylic-silicone based anti-scratch and anti-wear protecting topping is applied.

14. Appropriate fitting-out structures as defined in claim 12, wherein anti-slip zones are obtained by strewing 60 mesh grain sized aluminum oxide on the transparent polyurethane based resin coat immediately followed by the application of the transparent polyurethane based resin coat in the same zone, if possible after rolling of the first transparent polyurethane based resin coat so that the granules are strewn and the second transparent polyurethane based resin coat is applied with a period of 10 minutes.

15. Appropriate fitting-out structures as defined in claim 13, wherein anti-slip zones are obtained by strewing 60 mesh grain sized aluminum oxide on the transparent polyurethane based resin coat immediately followed by the application of the transparent polyurethane based resin coat in the same zone, if possible after rolling of the first transparent polyurethane based resin coat so that the granules are strewn and the second transparent polyurethane based resin coat is applied with a period of 10 minutes.

16. Appropriate fitting-out structures as defined in claim 1, wherein the floor foundation has a thickness of 25 mm, decorative finishing coat has a thickness of 2 mm, the transparent resin topping has a thickness of 200$\mu$ and the protective anti-scratch product has a thickness of 150$\mu$ .

17. Appropriate fitting-out structures as defined in claim 10, wherein a stainless steel plate jointing element (33) is used to connect two adjacent panels (25) when the wall (2) forms an interior angle, said jointing element (33) is rounded off at the apex of the angle and has two terminal edges (35, 36) which are complementary, as the first opposing edges (29, 30) of said panel (25).

18. Appropriate fitting-out structures as defined in claim 10, wherein a jointing element (34) in stainless steel is provided to connect two adjacent panels (25) if the wall (2) forms an outer corner, said jointing element (34) has two terminal edges (35, 36) that (34) are complementary with the edges (29, 30) of said panel (25).

19. Appropriate fitting-out structures as defined in claim 10, wherein the panel (25) is fastened by a screw (63) connecting a protruding flap (64) of the edge (30) to the C-shaped element (18), while the edges adjacent panels (25) restrain each other and a butt strap (37) is applied on the panel joint.

20. Appropriate fitting-out structures as defined in claim 1, wherein the corner fastening element (50) consists of one single prefabricated and flanged item formed by two C-shaped elements (18) cut and welded together at 90°.

21. Appropriate fitting-out structures as defined in claim 1, wherein an L-shaped finishing section (53) is mounted inside the corner formed between the wall and ceiling to round off any sharp edges between the wall and ceiling.

22. Appropriate fitting-out structures as defined in claim 21, further including special prefabricated L-shaped finishing elements comprising a first section (57) used with double panel (25) wall sections, a second section used for interior angles formed of adjacent panels (25), and a third section (59) used for outer corners formed of adjacent panels (25).

23. Appropriate fitting-out structures as defined in claim 1, wherein a double wall consisting of two separate panels (25" and 25'") are united and closed at their edges by a prefabricated element (38) in stainless steel plate of uniform thickness.

24. Appropriate fitting-out structures as defined in claim 1, wherein special prefabricated elements are provided for the coaming (9) to be used for an interior peripheral angle (39), for an outer peripheral corner (40), and where a double wall (41) will be mounted.

25. Appropriate fitting-out structures as define in claim 2, wherein special prefabricated elements are planned for said drain channel (42) to be used for L-shaped right angles (44) or for T-shaped (45) lines.

26. Appropriate fitting-out structures as defined in claim 1, which further includes a furnishing element (61) secured to the flooring by glueing a foot (60) of a furnishing element (61) to the floor foundation (4) while the flooring is being laid, with the utilization of a structural bonding agent (62) which is applied into a hollow cavity below the foot (60) which is then embedded and partially recovered by the finishing coat and resin topping.

27. Appropriate fitting-out structures as defined in claim 17, wherein said jointing element (33) is sized 150×150 mm.

28. Appropriate fitting-out structures as defined in claim 18, wherein said jointing element (34) is sized 150×150 mm.

29. Installation procedure for the appropriate fitting-out structures according to claim 2, comprising the following sequence: the coamings (9) are rigged and then glued onto the deck plates (7), the panels (25) are then mounted and fastened to the bulkhead (8) and to the deck above, the box shaped seatings (20) and the drain channels (21, 42, 46) are glued onto the deck plates (7), an adhesion booster is applied as a sticker between the floor foundation and the resin topping, as well as to the lower flaps (11, 11", 11", 11'") of the stainless steel sections, if necessary after having roughened their surface, the floor foundation is applied, followed by the application of the finishing coat, a transparent resin topping in which anti-slip granules are incorporated and finally topped by an acrylic-silicone based protective transparent anti-scratch and anti-wear blanket.

* * * * *

UNITED STATES PATENT AND TRADEMARK OFFICE

CERTIFICATE OF CORRECTION

PATENT NO. : 6,715,239 B2
DATED : April 6, 2004
INVENTOR(S) : Passalacqua et al.

It is certified that error appears in the above-identified patent and that said Letters Patent is hereby corrected as shown below:

Title page,
Item [30], Foreign Application Priority Data, should correctly read:
-- February 9, 2001 (IT)……...GE2001A000013 --.

Signed and Sealed this

Twentieth Day of July, 2004

JON W. DUDAS
*Acting Director of the United States Patent and Trademark Office*